United States Patent [19]

Vural et al.

[11] 4,382,715

[45] May 10, 1983

[54] MASS COMPENSATED IMPACTING APPARATUS

[75] Inventors: Gülertan Vural, Emmelshausen; Udo Carle, Höhr-Grenzhausen, both of Fed. Rep. of Germany

[73] Assignee: Koehring GmbH - Bomag Division, Bopard, Fed. Rep. of Germany

[21] Appl. No.: 169,592

[22] Filed: Jul. 17, 1980

[30] Foreign Application Priority Data

Jul. 17, 1979 [DE] Fed. Rep. of Germany ..... 2928870

[51] Int. Cl.[3] ..... E01C 19/41

[52] U.S. Cl. ..... 404/133; 404/117

[58] Field of Search ..... 404/133, 117; 74/87, 74/110

[56] References Cited

U.S. PATENT DOCUMENTS

| | | | |
|---|---|---|---|
| 3,717,100 | 2/1973 | Sieke | 404/133 X |
| 3,885,883 | 5/1975 | Sieke | 404/133 X |
| 3,909,148 | 9/1975 | Vural | 404/133 |
| 3,923,412 | 12/1975 | Linz | 404/133 |
| 4,082,471 | 4/1978 | Hiszpanski | 404/133 |
| 4,088,077 | 5/1978 | Beckman | 404/117 X |
| 4,105,356 | 8/1978 | Loveless | 404/117 |
| 4,127,351 | 11/1978 | Vural | 404/133 X |
| 4,176,983 | 12/1979 | Gardner | 404/117 |

*Primary Examiner*—Nile C. Byers, Jr.
*Attorney, Agent, or Firm*—Spencer & Kaye

[57] ABSTRACT

In a mass compensated impacting apparatus composed of at least one pair of impacting tools and a common tool carrier supporting the tools, there is provided a two-mass vibration excitation system associated with each tool and including vibrating masses which are positively linearly guided in an essentially non-resilient manner, and a unit driving the vibratory masses with phase relationships such that the resulting average of all mass forces becomes at least approximately zero.

21 Claims, 13 Drawing Figures

MASS COMPENSATED IMPACTING APPARATUS

BACKGROUND OF THE INVENTION

The present invention relates to a mass compensated impacting, i.e. tamping and/or striking, system of the type including at least one pair of tools constituting two impacting, i.e. tamping or striking, tools, respectively, which are connected to a common tool carrier and vibrate in phase opposition to one another.

In machines equipped with vibrating tools, for example ground compacting machines for road construction, excavating work in mines etc., there generally exists the difficulty that the vibrating masses transfer vibrations to the machine frame. These vibrations subject the machine frame to stresses which in the course of time may lead to material fatigue and damage. Various efforts have therefore been made to produce mass compensated tamping and/or striking machines.

In most of the prior art vibratory machines the vibrating masses are coupled together in a resilient manner and the system made up of the two vibrating masses is in turn coupled to the machine frame in a resilient manner. Such approaches to compensation are principally encumbered by the drawback that the coupling of the resilient mass systems gives rise to a number of inherent resonant frequencies. If the vibratory frequency of the tools should coincide with, or reach the vicinity of, such a frequency, the resonant behavior of the system may generate uncontrollable vibratory motion and forces so that operation in these frequency ranges must be avoided. In daily practice it is necessary, however, to adapt the vibrating frequency of the tools to the conditions encountered, e.g. to the consistency of the ground if compacting tools are being used, or to the material consistency if the machine is to perform excavation work. Therefore, there will be occasions when the optimum frequency for a particular task falls into one of the ranges which must be avoided.

If a plurality of tools are to be used in a common tool carrier or machine frame, respectively, it is practically impossible to achieve mass compensation if the vibrating masses are resiliently coupled together. The tool carrier may then be subjected to uncontrollably high stresses.

SUMMARY OF THE INVENTION

It is an object of the present invention to provide a mass compensated impacting, i.e. tamping and/or striking, system which enables the forces and moments transferred to the tool carrier or machine frame, respectively, to be optimally compensated, particularly if a plurality of tools are provided in a common tool carrier.

This and other objects, according to the invention, are accomplished by the provision of a mass compensated tamping and/or striking system of the above-mentioned type in which each tamping or striking tool has an associated two-mass vibration excitation system whose vibrating masses are positively linearly guided without resiliency, and the phase relationship between the vibrating masses is selected so that the resulting average of all forces produced by the masses becomes at least approximately zero.

Each two-mass vibration excitation system is tuned in such a manner that the product of the individual mass value and the associated amplitude of its linear vibratory movement is equal to the corresponding product of the other mass, and the tools of one pair of tools vibrate in phase opposition.

Each individual two-mass vibration excitation system is thus mass compensated in itself. There is thus established a physical relationship that the products of the respective mass values and their associated vibratory path amplitudes are always identical with respect to the total system center of gravity, which is stationary in space.

If the effect of self-compensation of the mass forces of a two-mass system were to be utilized to its fullest, the system would have to be suspended at its center of gravity. Since this will be possible in only the rarest of cases, a comparable result is achieved in that for the purpose of mass compensation a plurality of identical two-mass vibration exciters are arranged in a common machine frame in a specifically defined relationship to one another.

The tool may be a ground compacting tool or an excavation tool while the two-mass vibration excitation system may be rigidly fastened to, or resiliently suspended from, the common tool carrier.

According to a particularly preferred embodiment of the invention, each vibration excitation system includes a dual-action piston/cylinder unit including a piston whose two frontal, or end, faces can be charged preferably by a hydraulic fluid. This piston drives the one vibrating mass, and the associated cylinder drives the other vibrating mass, both along a linear path. The drive for the vibration excitation system may also be an arrangement having two eccentric masses which each rotate about an axis and counter to one another and are arranged parallel to one another so that they cause the housing surrounding them and the attached tool to perform linear vibrations.

The suspension of each individual two-mass vibration excitation system from a common tool carrier or machine frame, respectively, may be rigid or resilient, and may also be effected via a hydraulic or pneumatic lifting and compensating device including a piston/cylinder arrangement. The latter embodiment is particularly favorable because it simultaneously permits adaptation to the height of each individual tool and compensation of the forces transferred from one two-mass system to the tool carrier and then to a second two-mass system which is paired with the first system and vibrates in phase opposition to the first system. According to a preferred embodiment, the piston/cylinder arrangements are given a dual-action design for this purpose and the corresponding cylinder chambers are connected together. The piston movement effective in the direction of the tool carrier then causes a shift in the hydraulic fluid each time toward the corresponding cylinder chamber of the other system so that these forces are not transmitted to the tool carrier.

According to another advantageous embodiment, three two-mass systems are combined. In this case the phase shift of the vibrating amplitudes between the individual systems is 120° because in this arrangement the sum of the instantaneous values becomes zero for sinusoidal vibratory movements.

If during operation rotation of the tools with respect to one another is undesirable, the tools may be secured against such rotation. This may be done, according to one embodiment, by a guide rod fastened to the tool carrier and a sleeve fastened to the tool to slide on the guide rod.

According to another advantageous embodiment, the tool carrier is constructed as a working head for a compacting or excavating machine on which the pairs of tools are arranged, for example, in an axially or rotationally symmetrical manner, the tools themselves vibrating in a direction oblique to the perpendicular to the plane of the tool carrier. In this case, a number of tools may be arranged in a circle around the circumference of the working head while the working head itself may be designed to be rotatable.

According to another embodiment, at least two pairs of tools are arranged in a straight line on a common mobile machine frame, the pairs of tools being arranged one behind the other in the direction of movement, there being, for example, three pairs of tools.

According to a further embodiment, the tool has the shape of a roll with a roll drum being rotatably mounted on the one vibrating mass of the vibration excitation system. In this case the roll drum may be provided with rings of tools for excavating material.

DESCRIPTION OF THE PREFERRED EMBODIMENTS

Figure 1:
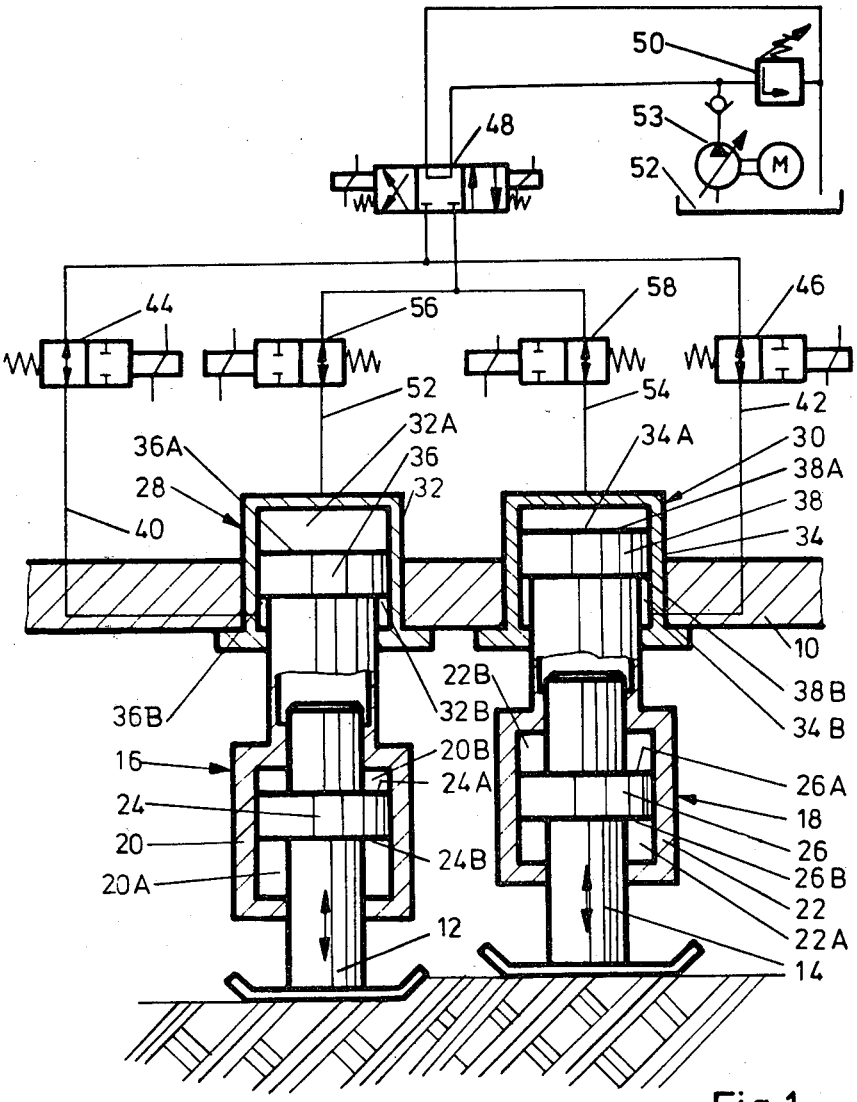
FIG. 1 is a partly cross-sectional and partly schematic representation of part of a mass compensated tamping system having two tamping tools, with associated vibration exciters and suspension devices and an associated hydraulic control system.

The embodiment of the mass compensated tamping system shown in FIG. 1 includes a tool carrier in the form of a machine frame 10 from which are suspended a plurality of tamping tools, one pair of such tools, 12 and 14, being shown in FIG. 1. Each of tools 12 and 14 has associated with it a two-mass vibration excitation system generally identified as 16 or 18, respectively. The system for each tool essentially comprises a dual action hydraulic piston/cylinder unit including a cylinder 20 or 22 and a piston 24 or 26. Both frontal faces 24A and 24B or 26A and 26B of the piston 24 or 26, respectively, can be subjected to hydraulic fluid loading. By suitably controlling the hydraulic fluid pressures in the two cylinder chambers 20A and 20B or 22A and 22B, respectively, formed between each piston and its associated cylinder, the two pistons 24 and 26 can be linearly driven with a phase shift of 180° between them. The tamping tools 12 and 14 are thus driven with a linear, reciprocating movement which is utilized to harden or compact the ground therebelow.

The suspension for each tool and its associated vibration exciter is provided by a hydraulic piston/cylinder arrangement 28 or 30, respectively. Each piston/cylinder arrangement 28, 30 includes a cylinder 32 or 34, respectively, which is fixed to the machine frame 10 as well as a piston 36 or 38, respectively, which is fitted to slide in the respective cylinder. The two piston/cylinder arrangements 28, 30 are also double acting; therefore each piston 36 or 38, respectively, has two frontal faces 36A and 36B or 38A and 38B, respectively, which can be subjected to a hydraulic fluid loading.

The two cylinder chambers 32B, 34B facing the respective tools are connected together by means of lines 40 and 42 and electromagnetically actuated two-position blocking valves 44 and 46. They are also connected, via a three position, two path directional control valve 48 and a settable pressure limiting valve 50, with a pressure source 53 in the form of a motor driven pump.

The other two cylinder chambers 32A, 34A are connected together via lines 52 and 54 and can be connected directly, or through two position blocking valves 56 and 58, respectively, with the pressure source 53 via one path of valve 48. FIG. 1 shows the center position of the valve 48 in which all cylinder chambers are blocked from the pressure source 53, internal compensation between the cylinder chambers 32A and 34A and between chambers 32B and 34B, respectively, being possible, however, via the open valves 56 and 58 or 44 and 46, respectively.

This embodiment operates as follows:

The tools 12 and 14 are positively controlled to reciprocate in phase opposition by the associated piston/cylinder units 16 and 18, wherein the resulting reaction forces are transferred to the pistons 36 and 38. In the position of the valves 44, 46, 56 and 58 shown in FIG. 1, the opposite-phase movements of the pistons 36 and 38 force the hydraulic fluid back and forth between the cylinder chambers 32A and 34A and between chambers 32B and 34B. The reaction forces are thus transferred from the one vibration excitation system to the other by way of the piston/cylinder arrangements 28, 30 and the connections existing between the cylinders thereof. The machine frame 10 is thus optimally protected against the influence of reaction forces.

Depending on the consistency of the ground and the type of work to be performed, the hydraulic system can be controlled in different ways to control the piston/-cylinder arrangements 28, 30.

If the ground is soft and to be packed down by a varying amount, valve 48 is shifted to the left so that cylinder chambers 32A and 34A receive a defined pressure while the pressure in cylinder chambers 32B and 34B is relaxed. This produces a defined bearing force about which the vibratory forces produced by the tool masses oscillate. The constant action of the bearing pressure causes the tools to follow the ground level.

If, however, the ground is to remain at a defined distance from the machine frame, the pistons 36 and 38 are first brought to the desired level by controlled operation of the various valves and then the valve 48 is closed, i.e. brought into the center position shown in FIG. 1, while valves 44, 46, 56 and 58 are left open, also as shown in FIG. 1. This interrupts the hydraulic follow-up while a compensation between the respective cylinder chambers continues to be effected via the open valves 44, 46, 56 and 58. The valves 44, 46, 56 and 58 serve mainly to permit positioning the individual piston/cylinder arrangements 28 and 30, respectively, because closing of the valves 44 and 56, for example, would exclude the unit 28 from the positioning process which is effected by switching the valve 48.

An overpressure protection may be provided in the hydraulic system to render harmless suddenly occurring forces, for example, when there suddenly appear great unevennesses in the ground. With an appropriate control, the valve 48 may also be designed as a control valve, for example so as to keep constant a certain center of vibration for the tools or to assure a certain follow-up rate.

Figure 2:
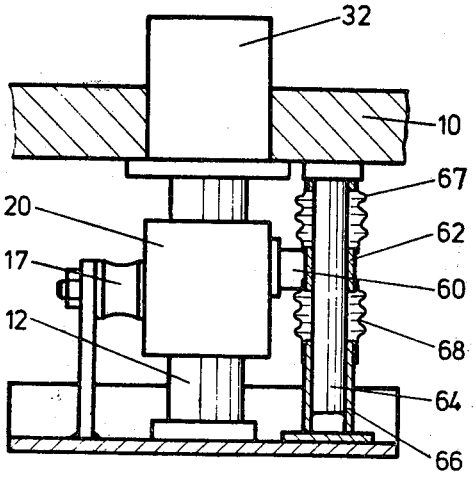
FIG. 2 is a partial cross-sectional side elevational view of one embodiment of a tamping tool and its associated means for securing it against rotation.

Preferably the vibration excitation systems are equipped with means to secure them against rotation if the tools are not rotationally symmetrical. One embodiment of such securing means is shown in FIG. 2. FIG. 2 shows only the essential parts of an individual tool, the associated vibration exciter and the machine frame. At the side of cylinder 20 there is mounted a short pipe 60 which is rigidly connected with a guide sleeve 62. The guide sleeve 62 is slidingly mounted on a shaft 64 whose upper end is rigidly connected with the machine frame 10 and whose lower end is guided in a sleeve 66 which itself is rigidly fastened to the tool 12. In order to provide a seal against the penetration of dirt and the like, bellows 67 and 68 are provided which enclose the free portion of the shaft 64. Each bellows 67, 68 is fastened between sleeve 62 and a respective one of frame 10 and sleeve 66.

As a further means for securing against rotation, the left side of FIG. 2 shows an embodiment composed of an elastically compressible rubber element 17 fastened between cylinder 20 and tool 12. The resiliency of element 17 in the vibrating direction is here selected to be slight so that the recoil, or reaction, forces remain negligible.

Figure 3:
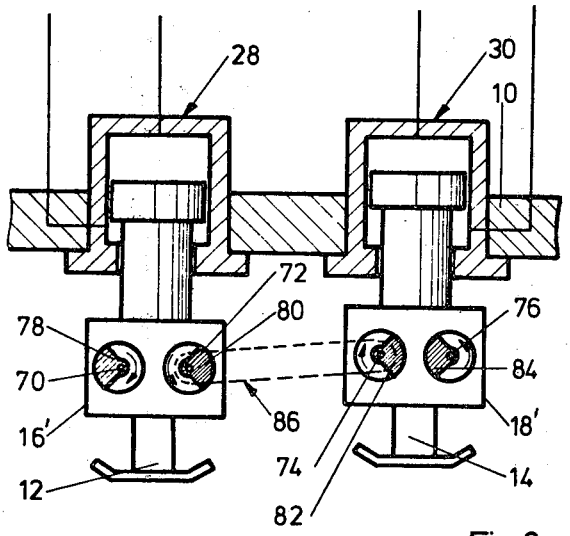
FIG. 3 is a partial cross-sectional view of two tamping tools with associated vibration exciters and suspension devices, the vibration exciters each being in the form of an arrangement of eccentric masses.

Similarly to FIG. 1, FIG. 3 shows two tamping tools 12 and 14 with their associated vibration exciters 16', 18' and piston/cylinder arrangements 28, 30 for suspending the tools from the machine frame. The vibration exciters, however, in contradistinction to the embodiment of FIG. 1, are not designed as linear drives but as eccentric drives. Each vibration exciter includes two mutually parallel shafts 70 and 72 or 74 and 76, respectively, on each of which is mounted an eccentric mass 78, 80 or 82, 84, respectively. The rotary movement of the eccentric masses is synchronized and the two masses of each exciter rotate in directions counter to one another. In addition, the masses of one exciter rotate to produce vibrations with a 180° phase shift from the adjacent exciter.

The required synchronization between two adjacent vibration exciters can be effected, for example, by means of a toothed belt 86 or the like which connects two adjacent shafts 72 and 74 or two adjacent vibration exciters 16' and 18'. Thus it is accomplished that the tools 14 and 12 vibrate in phase opposition. The piston/cylinder arrangements 28 and 30 are controlled in the same manner as in FIG. 1.

Figure 4:
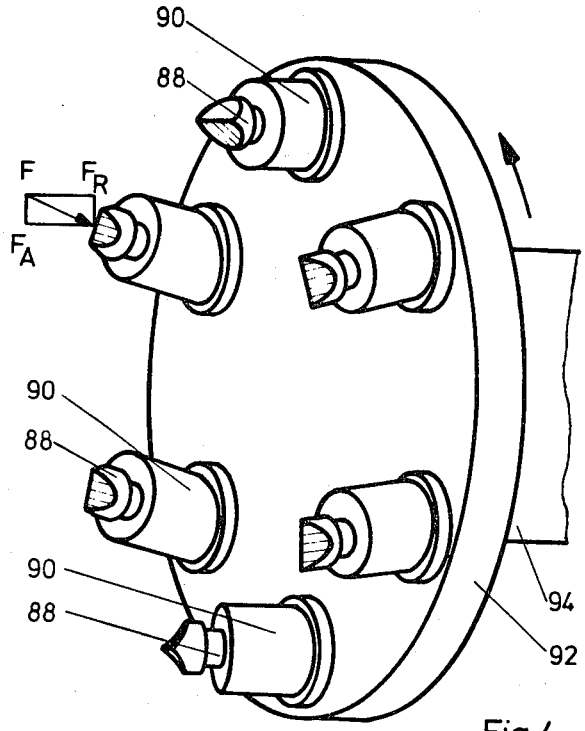
FIG. 4 is a simplified perspective view of a particular embodiment of the invention in which six chisel-type excavation tools are held by a common, circular, disc-type tool carrier.

In the embodiment shown in FIG. 4, six excavation tools 88 with their associated vibration exciters 90 are arranged on a common, circular disc-shaped tool carrier 92 which is also called a shield. This tool carrier is fastened to the end of a rotary boom arm 94. The design of each vibration exciter 90 corresponds to that according to FIG. 1 or FIGS. 1 and 2 and therefore need not be described in detail. The tools 88 are of the chisel type and serve to loosen or remove material for cutting a tunnel or shaft in a mine.

The tools and the associated vibration exciters are disposed at the circumference of the tool carrier 92 in such a manner that their axes are inclined by identical amounts with respect to the axis of the rotatable boom 94. This inclination results in a division of the striking force F into an axial component $F_A$ and a radial component $F_R$. The components $F_R$ induce a rotary movement of the tool carrier and thus result in uniform removal of rock, earth or the like.

Since each pair of tools is mass compensated in itself, no free dynamic attack the tool carrier 92 except for the torque and the disturbing forces created by the differences in spalling of the rock encountered.

Figure 5:
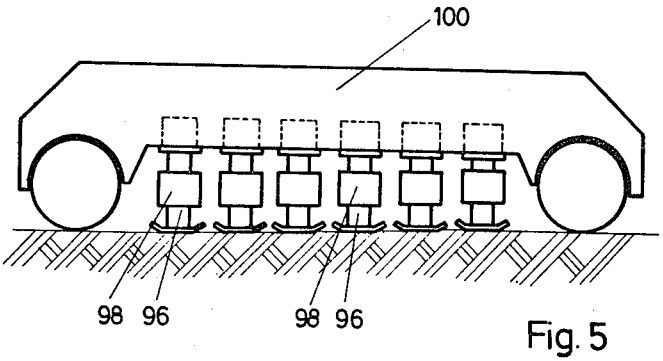
FIG. 5 is a simplified pictorial side elevational view of a further embodiment of the invention in which a series of tamping tools and associated vibration exciters as well as suspension devices are arranged one behind the other in the direction of movement of the movable machine frame of a ground compacting machine.

In the embodiment shown in FIG. 5, a series of tamping tools 96 with associated vibration exciters 98 is suspended in a straight line, one behind the other, from a common mobile machine frame 100. For example, six tamping tools are provided which are designed as those in the embodiment shown in FIG. 1. The schematic representation shows the tools one behind the other in the direction of movement; however, a plurality of tools may also be arranged in transverse juxtaposition. Two adjacent tools and vibration exciters may form a pair, or nonadjacent tools may be coupled in pairs. Here again the tool axes may be inclined with respect to the vertical, for example in order to promote forward movement of the frame.

Figure 6:
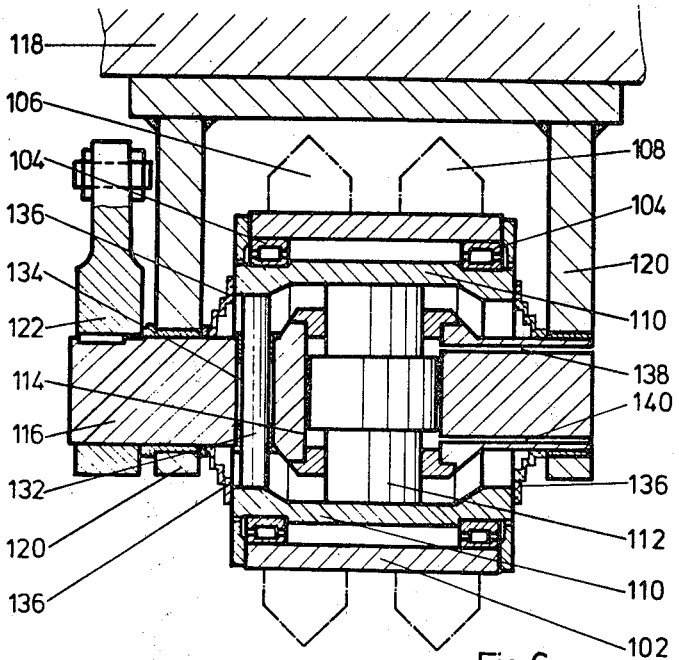
FIG. 6 is a cross-sectional view of an embodiment of a rolling tool seen along the tool axis.
Figure 7:
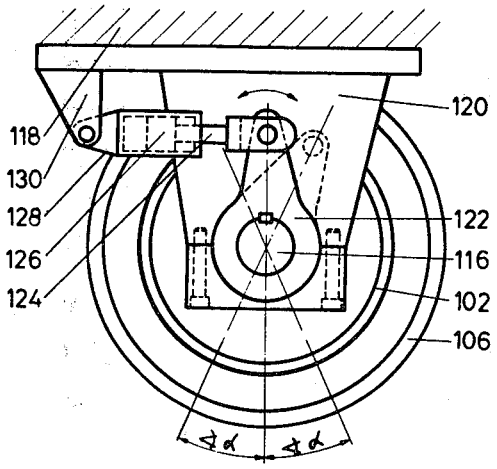
FIG. 7 is a side elevational view of the embodiment of FIG. 6.

FIG. 6 shows an embodiment having a rolling, vibrating tool in the form of a drum jacket 102. Such a drum jacket 102 with smooth surface is used, for example, to compact bulk material. FIG. 6 also shows in dashed lines ring tools 106, 108 which may be provided instead of a smooth drum surface and serve, for example, to break up or remove rock or the like. The drum jacket 102 is mounted by means of axially spaced roller bearings 104 on two diametrically opposite yokes 110 which are each rigidly connected with one end face of a piston 112. The piston 112 is slidingly fitted in a cylinder 114 which is formed to extend radially in the interior of a shaft 116. The shaft 116 is mounted to be rotatable about its axis in a frame 120 which is rigidly fixed to the machine frame 118. As can be seen in FIG. 7, which is a side view of this embodiment, a crank 122 is locked in at one end of the shaft 116 and a piston rod 124 is articulated to this crank 122. This piston rod 124 is connected with the piston 126 of a dual-action adjusting cylinder 128 which is articulated to a mount 130 which is rigidly connected with the machine frame 118. By means of the adjusting cylinder 128, the shaft 116 can be pivoted about its axis through an angle $2\alpha$. This also pivots the direction of vibration of piston 112 so that it forms an angle of up to $\alpha$ with the vertical. In this way, a force component for advancing or retarding the machine can be obtained from the striking force.

In this embodiment, the one mass of the vibratory system, i.e. the shaft 116 and the cylinder 114, is rigidly mounted to the machine frame 118. Therefore, the full reaction force of the vibratory movement of piston 112 and of the parts driven thereby are transferred to the machine frame 118. Therefore, at least two such tools are provided on the same machine frame 118 and are driven to vibrate with a 180° phase shift between them. The machine frame 118 then processes the reaction forces as internal forces so that no external forces are generated.

According to a preferred embodiment, the remaining moments which have a tendency to pivot the machine frame 118 are eliminated by mounting a further pair of tools at the same machine frame 118 in a mirror image arrangement. In order to keep the moment generated by one pair of tools as small as possible, the tools of one pair are preferably arranged closely together or one closely behind the other, respectively, in the machine frame 118. One adjusting cylinder 128 can then pivot two shafts 116 of one pair of tools simultaneously. For this purpose two cranks 122 may be coupled by a single push rod or the two shafts may be coupled along their axes and provided by means of a common crank.

According to a preferred embodiment, a plurality of pairs of tools are arranged on the advancing shield of a tunnel driving machine or the like, similarly as in the embodiment according to FIG. 4.

In the embodiment according to FIGS. 6 and 7 as well, there is provided a means for securing yokes 110 against rotation in the form of a rod 132 which connects the two yokes 110 together and which is slidingly mounted in a cylindrical bore 134 in shaft 116. As a protection against the penetration of foreign bodies, sealing elements 136 are provided which seal the axial end faces of the rolling tool.

Hydraulic lines 138 in the form of axial bores are cut through the shaft 116 to feed chambers of the cylinder 114.

Figure 8:
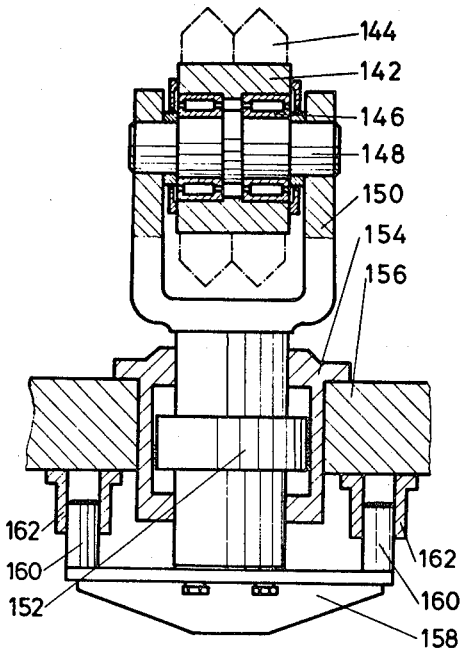
FIGS. 8 and 9 are schematic, partially cross-sectional views of further embodiments of a rolling tool according to the invention.
Figure 9:
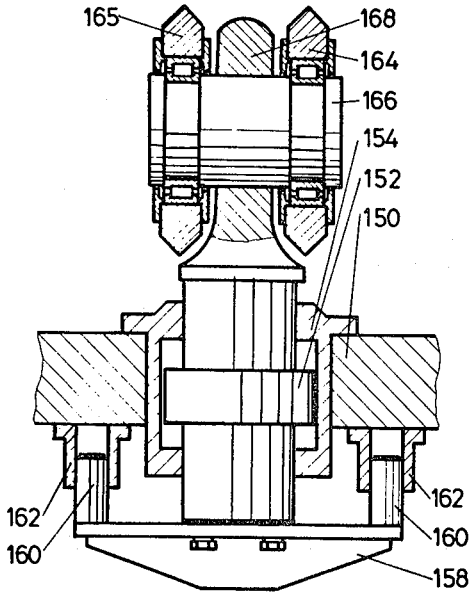

In the embodiments shown in FIGS. 8 and 9, there are likewise provided solid rolling tools. In the embodiment of FIG. 8, a cylindrical roller-shaped tool 142 is provided with annular tool rings 144 having a sharp edge and is rotatably mounted on a shaft 148 via slide or roller bearings 146. The shaft 148 is rigidly held in a fork-shaped mount 150. The mount 150 is rigidly connected to the piston 152 of a double-acting hydraulic cylinder 154 which constitutes the linear drive for the tool. The cylinder 154 is rigidly connected to a tool carrier 156. As a means to secure this assembly against rotation about the axis of piston 152, a yoke 158 is rigidly connected with the piston 152 and is equipped at its ends with guide bolts 160 which are oriented toward the tool carrier 156 and are slidably guided in sleeves 162 fastened to the tool carrier 156. These means to secure against rotation can be eliminated if a rotationally symmetrical tool is used. As a further means preventing rotation, it is conceivable to arrange resiliently compressible rubber elements between the frame 156 and the yoke 158 in a manner similar to the embodiment of FIG. 2.

The embodiment shown in FIG. 9 differs from that of FIG. 8 in that two rolling tools 164 and 165 are provided which are rotatably mounted at respective axial ends of a shaft 166 which is supported in its center region by a rod-shaped mount 168.

In the two embodiments shown in FIGS. 8 and 9, as in the embodiments of FIGS. 6 and 7, reaction forces are transferred to the machine frame 156. Therefore, two tools are always combined into a pair and are arranged at the tool carrier 156 to vibrate 180° out of phase with one another. To eliminate the remaining moments, two pairs of tools are preferably arranged in a mirror image pattern.

A rigid suspension of the vibration excitation system at the machine frame has the advantage that the entire piston stroke is available for moving the tool. However, for numerous applications, it is of advantage to have an elastic suspension for the vibration exciter and the tool driver thereby. Two embodiments of this type are shown in FIGS. 10 and 11.

Figure 10:
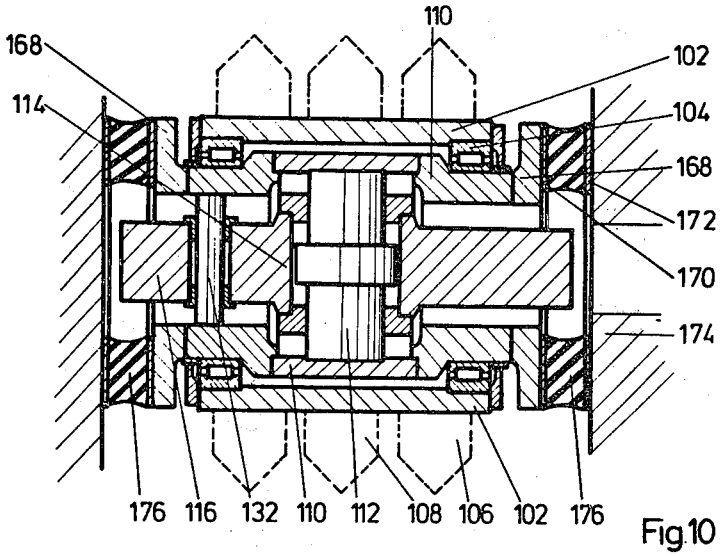
FIGS. 10 and 11 are cross-sectional views of embodiments of a rolling tool which is resiliently suspended from a machine frame.
Figure 11:
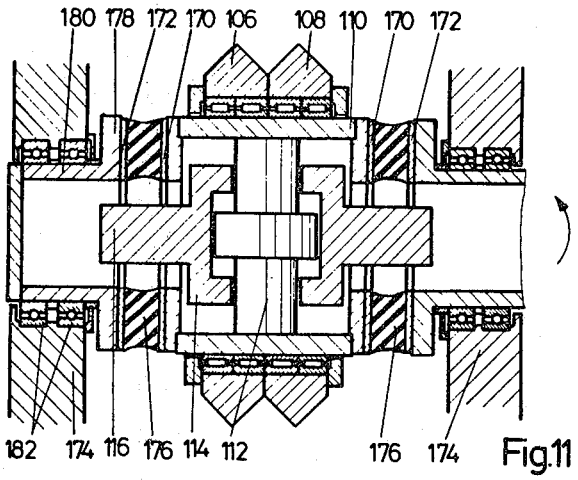

The embodiment shown in FIG. 10 is similar to that of FIG. 6 so that only the features different from FIGS. 6 will be described. Here, each yoke 110 is connected at both ends with respective annular suspension plates 168 at the end face of each of which there is fastened a likewise annular fastening plate 170. Thus, each plate 168 and plate 170 is connected to an associated end of each yoke 110. A corresponding fastening plate 172 is connected to the machine frame 174 in parallel with each plate 170.

Between each pair of fastening plates 170 and 172 there is disposed an annular, elastic suspension element 176 which is vulcanized in and through which the tool and the associated vibration exciter are suspended from the machine frame. The annular suspension element 176 simultaneously seals the interior of the tool against the outside and thus protects it against the penetration of impurities.

Generally, rolling compacting tools in compacting machines for earth moving and road construction are provided with rotating eccentric masses for the generation of vibrations. These eccentric masses cause so-called nondirectional vibratory movement of the cylindrical tool, i.e. the direction of vibration rotates about a center. That means that the vibratory movement takes place not only perpendicularly to the surface to be compacted but also parallel thereto, i.e. in the direction of movement of the machine. Since the compacting tools of such machines usually also must perform driving and steering functions, the horizontal components of the vibratory movement have an unfavorable influence on the suspension in the machine frame. The elastic suspension elements should have the lowest spring stiffness as possible so that the machine frame remains essentially protected against the dynamic vibratory forces. On the other hand, the driving and steering function for the rolling tool requires a relatively hard spring support in the horizontal direction so that instability in traction and during travel around curves can be prevented. This, however, again results in increased shock stresses on the machine frame and thus on the entire machine and on the operator.

A solution to this problem offered by the present invention, i.e. to substantially free the machine frame of dynamic forces resulting from movement of the tool, is accomplished in the embodiments shown in FIGS. 10 and 11 in that each respective two-mass linear excitation system generates vibration in only one direction. Thus the resiliency of the suspension element 176 can be different along its major axes. For example, a relatively low spring stiffness is provided in the direction of the vibrations and a relatively great stiffness is provided in the direction perpendicular to the vibrations and thus the above-described drawbacks are avoided.

The embodiment shown in FIG. 11 essentially differs from that of FIG. 10 in that the vibration exciter of the tool is rotatably mounted in the machine frame. Each outer fastening plate 172 is connected with the flange 178 of a respective bearing hub 180 which is mounted on roller bearings 182 in a cylindrical bore in the machine frame 174.

In the embodiment of FIG. 11 the means 132, 134 for preventing rotation between cylinder 116 and yokes 110, as in the embodiments of FIGS. 6 and 10, are not shown for the sake of simplicity but they are preferably provided as well.

In the embodiment of FIG. 11, the direction of vibration of the tool can be selected by pivoting the shaft 116 about its axis, a control mechanism being provided for this pivoting which is similar to that shown in FIGS. 6 and 7 so as to engage at one of the bearing hubs 180.

Figure 12:
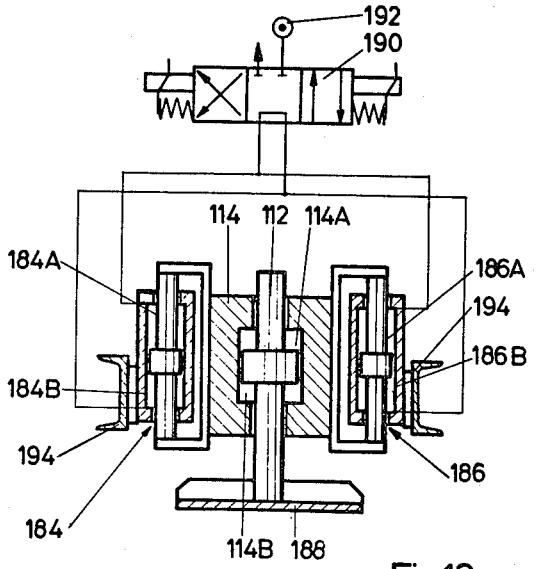
FIG. 12 is a partly cross-sectional and partly schematic elevational view of a further embodiment in which there are provided two lateral guide columns.

In the embodiment of FIG. 12, two lateral guide columns 184, 186 are provided instead of a resilient suspension at the machine frame. In a cylinder 114 which simultaneously serves as the upper mass, there is mounted a piston 112 which has a tool foot 188 constituting the lower mass. The cylinder chambers 114A, 114B formed in cylinder 114 are supplied alternatingly with pressure fluid and the upper and lower masses vibrate counter to one another, according to the law of maintaining the system center of gravity, with the relatively heavier upper mass 114 having the lower vibrating amplitude.

In the illustrated center position of the directional control valve 190 which is fed by a pressure source 192, the chambers 184A, 184B, 186A and 186B of the two guide columns 184 and 186 are connected together so that the upper mass can vibrate freely with respect to the machine frame 194 without the generation of reaction forces. The guide columns 184 and 186 are fastened via their cylinders to the machine frame 194 and via their piston rods to the upper mass 114. Between the upper mass and tool foot 188 there may be disposed a means for securing against rotation of the type shown in FIG. 2. Depending on the position of valve 190, the entire unit can be raised or lowered, or, if the valve 190 is used as a control valve, a certain bearing or follow-up force can be set, as described above with reference to FIG. 1.

Figure 13:
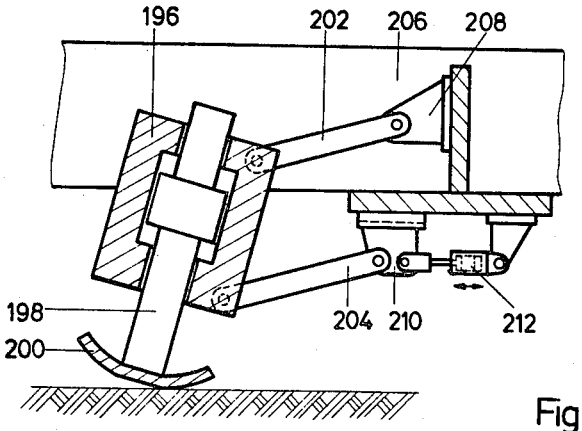
FIG. 13 is a cross-sectional elevational view of an embodiment in which a tool is dragged by a movable machine frame.

FIG. 13 shows an embodiment in which a tamping system comprising a cylinder 196 and piston 198 having a tamping tool 200 fastened thereto is articulated to a machine frame 206 by means of two longitudinal steering links 202 and 204 articulated to cylinder 196. The point of articulation of steering link 200 at the machine frame 206 is fixed while the steering link 204 is articulated to the machine frame via a horizontally displaceable bearing 210, which can be displaced or blocked, respectively, by means of an adjusting cylinder 212. Thus the axis of the tool can be inclined toward the ground if required.

In a modification of the embodiment shown in FIG. 13, the adjusting cylinder 212 can be driven periodically at an adjustable frequency in such a manner that a horizontal component is superposed on the movement of the tool to compensate relative movement of mobile tool carrier 206 with respect to the ground in the contact region between tool and ground. This has the result that at the moment when the tool contacts the ground the tool has only a vertical component in its movement relative to the ground and thus the surface of the ground being worked is not stressed in the horizontal direction. Thus it is assured that even with surfaces which are very sensitive to horizontal displacement no cracks can develop due to horizontal movement components of the tools.

It will be understood that the above description of the present invention is susceptible to various modifications, changes and adaptations, and the same are intended to be comprehended within the meaning and range of equivalents of the appended claims.

What is claimed is:

1. In a mass compensated impacting apparatus composed of at least one pair of impacting tools and a common tool carrier supporting the tools, the improvement comprising a two-mass vibration excitation system associated with each said tool and including vibrating masses which are positively linearly guided in an essentially non-resilient manner, and means driving said vibratory masses with phase relationships such that the resulting average of all mass forces becomes at least approximately zero.

2. Apparatus as defined in claim 1 wherein there is a plurality of said pairs of tools presenting a set of said tools which are fastened to said common tool carrier, and said means drive said vibrating masses in a manner that causes said two-mass vibration excitation systems to vibrate with such a phase shift relative to one another that the sum of the instantaneous values of the dynamic forces produced thereby over a vibration period of 360° equals zero.

3. Apparatus as defined in claim 2 further comprising a double acting hydraulic piston/cylinder unit connecting each said two-mass vibration excitation system to said common tool carrier, with the cylinder of said unit being connected rigidly to said common tool carrier and the piston of said unit being connected rigidly with its associated two-mass vibration excitation system.

4. Apparatus as defined in claim 3 wherein there are at least two said hydraulic units each associated with a respective excitation system, with the cylinder of each said unit presenting two cylinder chambers, and further comprising: connecting lines connected between corresponding chambers of two said units; blocking valves connected in said connecting lines; and a directional control valve connected between said blocking valves and a hydraulic pressure fluid supply for selectively connecting said blocking valves to the fluid supply.

5. Apparatus as defined in claim 1, 2, 3 or 4 wherein each said two-mass vibration excitation system comprises a double acting hydraulic piston/cylinder member arranged to drive its associated tool.

6. Apparatus as defined in claim 5 wherein said tool carrier extends along a reference plane and further comprising means connected for orienting each said excitation system to cause its associated tool to vibrate in a direction which is inclined with respect to the normal to the reference plane.

7. Apparatus as defined in claim 6 wherein said tool carrier constitutes the working head of an excavating machine and has a longitudinal axis, and there is a plurality of pairs of said tools arranged in such a way that the sum of the momentary values of the dynamic forces and moments produced by said excitation systems with respect to the axis of said carrier is approximately zero.

8. Apparatus as defined in claim 6 wherein said carrier is a mobile machine frame and there are at least two said pairs of tools arranged in a straight line on said machine frame.

9. Apparatus as defined in claim 1 or 2 wherein each said tool has the form of a roller and comprises a roller drum which is rotatably mounted on one vibrating mass of its associated excitation system, the other mass of the associated excitation system comprises a shaft rigidly connected to said carrier and provided with a cylindrical bore located in said shaft and having a vertical axis, and each said excitation system comprises a piston which can be charged with fluid at both its end faces and which is slidingly fitted in said bore.

10. Apparatus as defined in claim 9 wherein said tool carrier extends along a reference plane and further comprising means for pivoting said shaft in such a manner as to cause the sliding movement of said piston to be in a direction which is inclined to the perpendicular to the reference plane.

11. Apparatus as defined in claim 9 further comprising means resiliently suspending said one mass of each said two-mass vibration excitation system from said tool carrier.

12. Apparatus as defined in claim 11 wherein said means resiliently suspending comprises a hollow cylindrical, elastic suspension element which engages via one axial end face at said one mass concentrically with said shaft and engages with its other axial end face at said tool carrier.

13. Apparatus as defined in claim 1 or 2 wherein each said excitation system comprises a double acting hydraulic piston/cylinder member arranged to drive its associated tool, and one mass of each said excitation system comprises: the piston of said piston/cylinder member; a fork shaped mount connected to said piston; a shaft carried by said mount; and said associated tool in the form of a rolling tool rotatably mounted on said shaft.

14. Apparatus as defined in claim 1 or 2 wherein each said excitation system comprises a double acting hydraulic piston/cylinder member arranged to drive its associated tool, and one mass of each said excitation system comprises: the piston of said piston/cylinder member; a post-shaped mount connected to said piston; a shaft carried by, and extending through, said mount; and said associated tool in the form of two rolling tool elements rotatably mounted on said shaft and spaced from one another along the axis of said shaft.

15. Apparatus as defined in claim 1 or 2 further comprising a longitudinal steering element connecting each said two-mass vibration excitation system with said common tool carrier.

16. Apparatus as defined in claim 15 further comprising means including a piston/cylinder unit connected to said longitudinal steering element and to an associated excitation system for pivoting said system in a vertical plane.

17. Apparatus as defined in claim 16 wherein said tool carrier is mobile and further comprising means driving said piston/cylinder unit periodically in such a manner that a horizontal component is superposed over the movement of said tool which compensates for the relative movement of said mobile tool carrier across the ground in the contact region between said tool and the ground.

18. Apparatus as defined in claim 1 or 2 wherein said tool carrier extends along a reference plane and further comprising means connected for orienting each said excitation system to cause its associated tool to vibrate in a direction which is inclined with respect to the normal to the reference plane.

19. Apparatus as defined in claim 1, 2, 3, or 4 wherein said tool carrier constitutes the working head of a compacting or excavating machine and has a longitudinal axis, and there is a plurality of pairs of said tools arranged in such a way that the sum of the momentary values of the dynamic forces and moments produced by said excitation systems with respect to the axis of said carrier is approximately zero.

20. Apparatus as defined in claim 5 wherein said carrier is a mobile machine frame and there are at least two said pairs of tools arranged in a straight line on said machine frame.

21. Apparatus as defined in claim 1, 2, 3 or 4 wherein said carrier is a mobile machine frame and there are at least two said pairs of tools arranged in a straight line on said machine frame.

* * * * *